US008513899B2

(12) United States Patent
Kang et al.

(10) Patent No.: US 8,513,899 B2
(45) Date of Patent: Aug. 20, 2013

(54) LIGHT EMITTING DEVICE AND DRIVING CIRCUIT THEREOF

(75) Inventors: Hyun Gu Kang, Ansan-si (KR); Sang Min Lee, Ansan-si (KR); Yoon Seok Lee, Ansan-si (KR); Won Il Kim, Ansan-si (KR); You Jin Kwon, Ansan-si (KR)

(73) Assignee: Seoul Semiconductor Co., Ltd., Seoul (KR)

( * ) Notice: Subject to any disclaimer, the term of this patent is extended or adjusted under 35 U.S.C. 154(b) by 824 days.

(21) Appl. No.: 12/550,912

(22) Filed: Aug. 31, 2009

(65) Prior Publication Data

US 2010/0237800 A1 Sep. 23, 2010

(30) Foreign Application Priority Data

Mar. 18, 2009 (KR) ..... 10-2009-0022891
May 15, 2009 (KR) ..... 10-2009-0042325

(51) Int. Cl.
*H05B 37/02* (2006.01)

(52) U.S. Cl.
USPC ..... 315/294; 315/297; 362/543

(58) Field of Classification Search
USPC ..... 315/294–297; 362/543, 545, 631, 362/630
See application file for complete search history.

(56) References Cited

U.S. PATENT DOCUMENTS

| | | | | |
|---|---|---|---|---|
| 6,285,140 | B1 * | 9/2001 | Ruxton | 315/312 |
| 7,847,487 | B2 * | 12/2010 | Kato | 315/192 |
| 8,035,307 | B2 * | 10/2011 | Chew | 315/200 R |
| 8,120,278 | B2 * | 2/2012 | Choi et al. | 315/294 |
| 2009/0230883 | A1 * | 9/2009 | Haug | 315/297 |

FOREIGN PATENT DOCUMENTS

| | | |
|---|---|---|
| JP | 2006-230896 | 9/2006 |
| KR | 10-0843402 | 6/2008 |
| KR | 10-2008-00076504 | 8/2008 |
| KR | 10-2009-00001101 | 1/2009 |

* cited by examiner

*Primary Examiner* — James H Cho
(74) *Attorney, Agent, or Firm* — H.C. Park & Associates, PLC

(57) ABSTRACT

A light emitting device comprises a first light emitting unit and a second light emitting unit connected in series with each other, and a PTF unit connected in parallel with the first light emitting unit and in series with the second light emitting unit. Each of the first light emitting unit and second light emitting unit comprises at least one LED. The PTF unit allows the second light emitting unit to be operated before operation of the first light emitting unit upon application of an AC voltage source. The light emitting device reduces total harmonic distortion and flickering, and improves power factor and optical efficiency. A driving circuit of the light emitting device is also disclosed.

17 Claims, 14 Drawing Sheets

Related Art

LIGHT EMITTING DEVICE AND DRIVING CIRCUIT THEREOF

CROSS REFERENCE TO RELATED APPLICATIONS

This application claims priority from and the benefit of Korean Patent Application No. 10-2009-0022891, filed on Mar. 18, 2009, and Korean Patent Application No. 10-2009-0042325, filed on May 15, 2009, which are both hereby incorporated by reference for all purposes as if fully set forth herein.

BACKGROUND OF THE INVENTION

1. Field of the Invention

The present invention relates to a light emitting device and driving circuit thereof and, more particularly, to a light emitting device and driving circuit thereof that can improve a power factor and optical efficiency while reducing total harmonic distortion and flickering.

2. Discussion of the Background

Light emitting diodes (LEDs) also exhibit common characteristics of diodes that are turned on upon application of a forward threshold voltage or more thereto. Further, two or more LEDs may be connected in inverse parallel with each other in order to increase a light emitting region upon application of an AC voltage source (hereinafter, the connected LEDs will be referred to as an "AC LED"). In this case, in a positive half-period of the AC voltage source, the AC LED is turned on by application of a forward threshold voltage or more to the LEDs connected to each other in the forward direction with respect to the positive half-period of the voltage, and in a negative half-period of the AC voltage source, the AC LED is turned on by application of a forward threshold voltage or more to the LEDs connected to each other in the forward direction with respect to the negative half-period of the voltage.

When applying the AC voltage source, each of the LEDs has a short operating region, which causes a problem of deterioration in optical efficiency of the AC LED by severe flickering or total harmonic distortion. Such problems may become severe when multiple AC LEDs are connected in series. The problems of the AC LED will be described hereinafter with reference to the drawings.

FIG. 1 is an equivalent circuit diagram of a conventional AC LED, and FIG. 2 is a graph depicting voltage-current characteristics of the AC LED shown in FIG. 1.

Referring to FIG. 1, a light emitting device 10, an AC voltage source $V_{ac}$, and a resistor $R_{11}$ are connected in series with one another. Here, LED 12 ($D_{11}$, $D_{12}$) and LED 14 ($D_{13}$, $D_{14}$) will be referred to as AC LEDs.

When a positive half-period of the AC voltage source $V_{ac}$ is applied to AC LED 12 and AC LED 14, LED $D_{11}$ and LED $D_{13}$ are operated. It should be understood that, since the LED $D_{11}$ and LED $D_{13}$ are connected in series, LED $D_{11}$ and LED $D_{13}$ are operated when the voltage is greater than the sum of forward threshold voltages of LED $D_{11}$ and LED $D_{13}$.

Similarly, when a negative half-period of the AC voltage source $V_{ac}$ is applied to AC LED 14 and AC LED 12, LED $D_{14}$ and LED $D_{12}$ are operated. In this case, LED $D_{14}$ and LED $D_{12}$ are operated when the voltage is greater than the sum of the forward threshold voltages of LED $D_{14}$ and LED $D_{12}$. Herein, operation of the LEDs will be construed as referring to light emission operation of the LEDs in the following description.

When AC LED 12 and AC LED 14 are operated in the positive or negative half-period of the AC voltage source $V_{ac}$, a current is dependent on the resistor $R_{11}$.

In FIG. 2, $v_1$ is a voltage graph and $i_1$ is a current graph. The x-axis indicates time and the y-axis indicates the intensity of current or voltage. This will be identically applied to all of the following voltage and current graphs.

As described in FIG. 1, in application of the AC voltage source $V_{ac}$ to the AC LEDs, a current is allowed to flow through the AC LEDs when the voltage is greater than the sum of the forward threshold voltages of the respective LEDs connected in a forward direction with respect to the AC voltage source $V_{ac}$ according to the positive or negative half-period of the AC voltage source $V_{ac}$. Such characteristics are clearly shown by the voltage-current graphs of FIG. 2. It should be understood that, when the light emitting device comprises a single AC LED 12 or AC LED 14, it also exhibits similar voltage-current characteristics to the light emitting device described above. Furthermore, although two AC LEDs, LED 12 and LED 14, are shown in FIG. 1, a light emitting device comprising three or more AC LEDs also exhibits similar voltage-current characteristics to those of FIG. 2.

Such characteristics of AC LED 12 and AC LED 14 operated only by an AC voltage higher than or equal to the sum of the forward threshold voltages cause several problems. In other words, when the AC voltage source $V_{ac}$ applied to AC LED 12 and AC LED 14 is higher than or equal to the sum of the forward threshold voltages of the LEDs connected in the forward direction with respect to the voltage, a current flows through the AC LEDs suddenly, and a short operating region is provided to the AC LEDs for a single period of the AC voltage source applied thereto, thereby causing an increase in total harmonic distortion (THD), excessive flickering, and deterioration in optical efficiency.

Therefore, there is an urgent need for a light emitting device or driving circuit thereof that can solve problems caused by the operating characteristics of the AC LED upon application of an AC voltage source, such as power factor decrease, total harmonic distortion, and excessive flickering.

SUMMARY OF THE INVENTION

Exemplary embodiments of the present invention provide a light emitting device and a driving circuit thereof that can solve problems such as a decrease in power factor, an increase in total harmonic distortion and excessive flickering, due to operating characteristics of an AC LED, that is, a sudden current when an AC voltage source applied to the AC LED is higher than or equal to the sum of forward threshold voltages of LEDs connected in a forward direction with respect to the voltage, and a short operating region of the AC LED for a single period of the AC voltage source applied thereto.

Additional features of the invention will be set forth in the description which follows, and in part will be apparent from the description, or may be learned by practice of the invention.

An exemplary embodiment of the present invention discloses a light emitting device comprising a first light emitting unit and a second light emitting unit connected in series with each other, each of the first light emitting unit and the second light emitting unit comprising at least one light emitting diode (LED); and a PTF unit connected in parallel with the first light emitting unit and in series with the second light emitting unit, the PTF unit to allow the second light emitting unit to be operated before operation of the first light emitting unit upon application of an AC voltage source.

An exemplary embodiment of the present invention also discloses a light emitting device comprising a first light emitting unit and a second light emitting unit connected in inverse parallel with each other, each of the first light emitting unit and the second light emitting unit comprising at least two light emitting diodes (LEDs) connected in series with each other in a forward direction; a first PTF unit connected in parallel with at least one LED of the first light emitting unit; and a second PTF unit connected in parallel with at least one LED of the second light emitting unit.

An exemplary embodiment of the present invention also discloses a light emitting device comprising a first light emitting group comprising at least one first light emitting unit comprising at least one light emitting diode (LED); a second light emitting group comprising at least one second light emitting unit comprising at least one LED; and at least one PTF unit connected in parallel with the first light emitting group and in series with the second light emitting group, the PTF unit to allow the second light emitting group to be operated before operation of the first light emitting group upon application of an AC voltage source.

An exemplary embodiment of the present invention also discloses a driving circuit for driving a light emitting device using an AC voltage source, the light emitting device comprising a first light emitting unit and a second light emitting unit each comprising at least one LED and being connected in series with each other via a first node, the driving circuit comprising a first resistor connected in series with the first light emitting unit via a second node; a capacitor connected in parallel with the first light emitting unit and the first resistor between a third node and the first node; and a second resistor connected in series with the capacitor between the third node and the first node.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
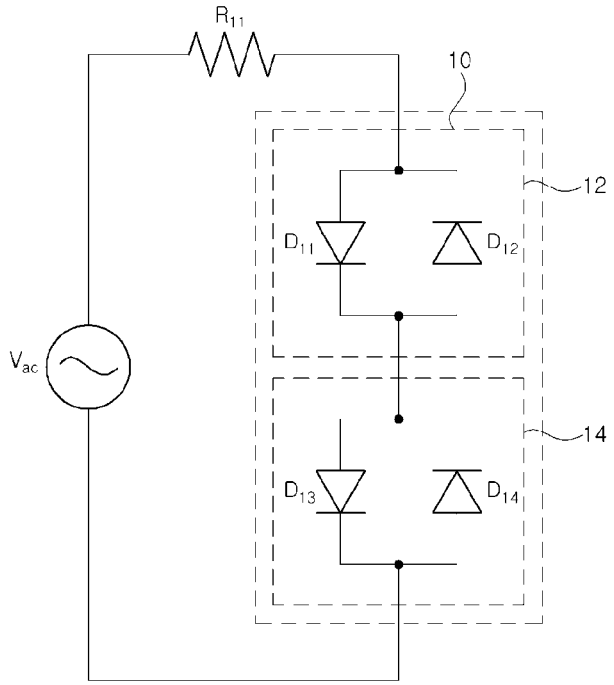
FIG. 1 is an equivalent circuit diagram of a conventional AC LED.

The invention is described more fully hereinafter with reference to the accompanying drawings, in which exemplary embodiments of the invention are shown. This invention may, however, be embodied in many different forms and should not be construed as limited to the embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Figure 3:
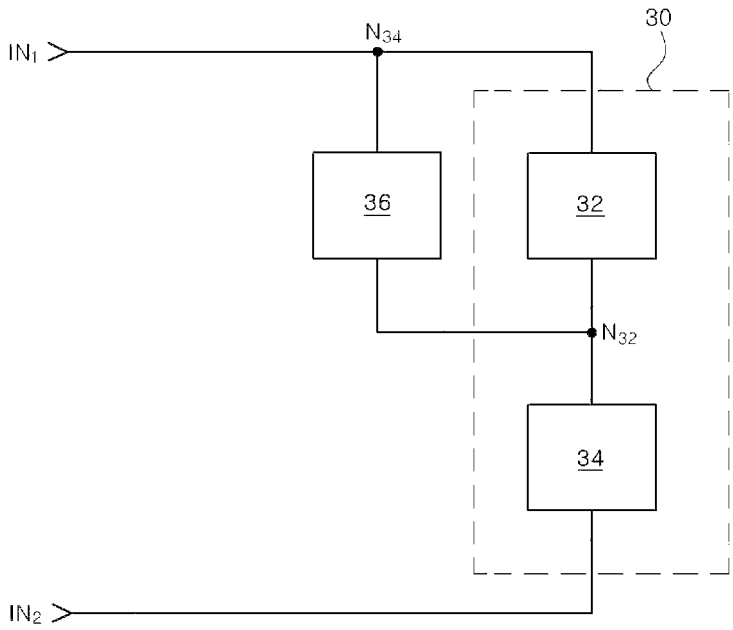
FIG. 3, FIG. 4, and FIG. 5 are block diagrams of light emitting devices or driving circuits thereof according to exemplary embodiments of the present invention.
Figure 4:
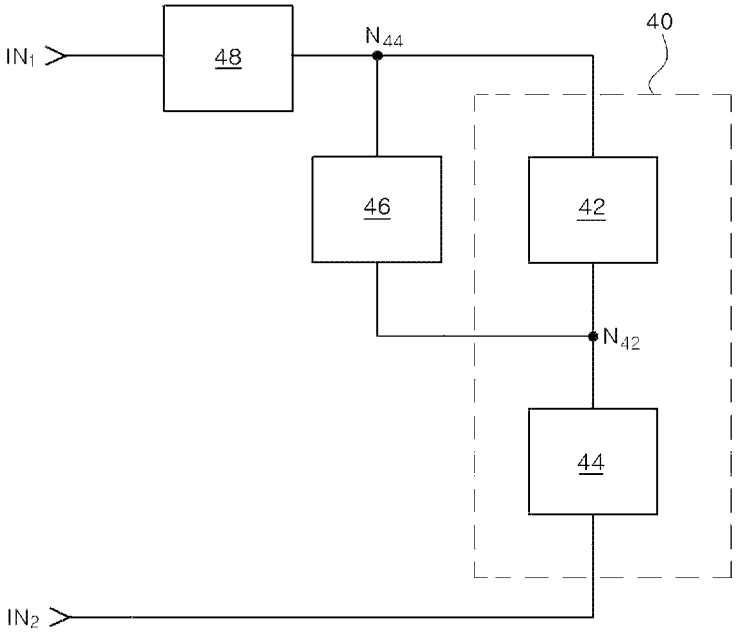
Figure 5:
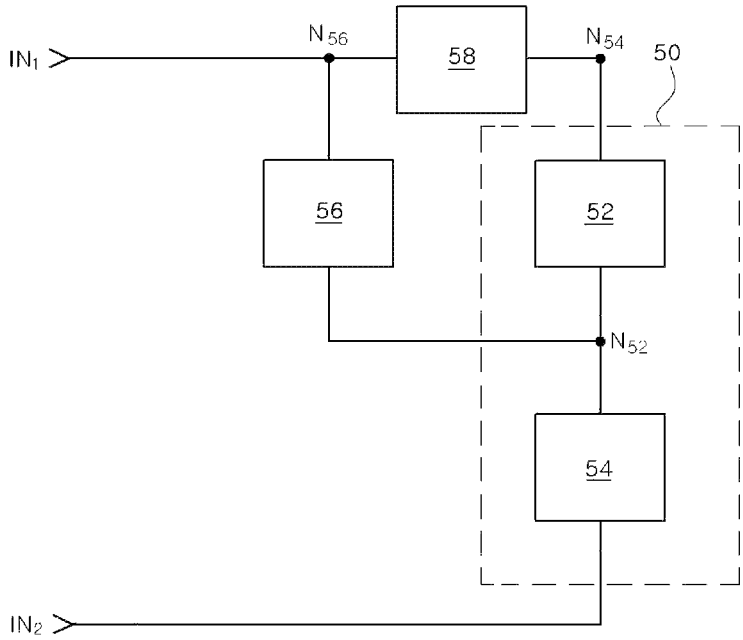

FIG. 3, FIG. 4, and FIG. 5 are block diagrams of light emitting devices or driving circuits thereof according to exemplary embodiments of the present invention.

Referring to FIG. 3, a light emitting device 30 comprises a first light emitting unit 32, a second light emitting unit 34, and a PTF unit 36. Each of the first light emitting unit 32 and second light emitting unit 34 comprises at least two LEDs which are connected in inverse parallel with each other. The PTF unit 36 is connected in parallel with the first light emitting unit 32 and in series with the second light emitting unit 34 to allow the second light emitting unit 34 to be operated before operation of the first light emitting unit 32 when an AC voltage source is applied to power source input terminals $IN_1$, $IN_2$.

The PTF unit 36 may comprise a variety of elements, such as resistors, capacitors, inductors, and the like. That is, the PTF unit 36 may comprise various elements so long as they allow the second light emitting unit 34 to be operated before operation of the first light emitting unit 32 upon application of the AC voltage source.

For example, assuming that the first light emitting unit 32 is an AC LED comprising two LEDs connected in inverse parallel with each other and the second light emitting unit 34 is another AC LED comprising two LEDs connected in inverse parallel with each other, the operation of the first light emitting unit 32 means operation of an LED connected in a forward direction among the two LEDs within the AC LED.

In other words, a current flows through a path of a node $N_{34}$, PTF unit 36, node $N_{32}$, and second light emitting unit 34 before operation of the LED connected in the forward direction with respect to the AC voltage source within the first light emitting unit 32 (that is, when a forward voltage is less than a forward threshold voltage of the LED in the first light emitting unit 32 but is higher than a forward threshold voltage of the LED in the second light emitting unit 34), as will be described in detail below. On the contrary, when not comprising the PTF unit 36, the light emitting unit is operated only by application of a voltage higher than the sum of the forward threshold voltage of the LED in the first light emitting unit 32 and the forward threshold voltage of the LED in the second light emitting unit 34, as described above.

Compared with the light emitting device not comprising the PTF unit 36, the light emitting device according to this exemplary embodiment has a much longer operating period and can suppress flow of a sudden current in the case where the applied AC voltage source is higher than or equal to the sum of the forward threshold voltages of the LEDs connected in the forward direction with respect to the AC voltage source according to the positive or negative half-period of the AC voltage source in the first light emitting unit 32 and the second light emitting unit 34. As a result, the light emitting device of this embodiment has an improved power factor, and reduces total harmonic distortion and flickering. Since the PTF unit 36 is related to improvement in power factor, total harmonic distortion and flickering, "PTF" is an abbreviation derived from these improvements.

It should be understood that the PTF unit 36 connected in parallel with the second light emitting unit 34 can perform the same function, although FIG. 3 illustrates the PTF unit 36 as being connected in parallel with the first light emitting unit 32. Further, each of the light emitting units may be configured such that an inverse parallel connection of a single LED or an inverse parallel connection combination of two LEDs is formed in a single package. Alternatively, the entire light emitting unit comprising the PTF unit 36 may be formed in a single package.

In addition, although a single first light emitting unit 32 and a single second light emitting unit 34 are provided to the light emitting device in this embodiment, at least one third light emitting unit may be connected in parallel with each of the first light emitting unit 32 and the second light emitting unit 34. Further, a number of light emitting devices, each of which comprises the first light emitting unit 32, the PTF 36, and the second light emitting unit 34, may be consecutively connected in parallel with each other.

Furthermore, at least one third light emitting unit may be connected in series with each of the first light emitting unit 32 and the second light emitting unit 34 or to each of the first light emitting unit 32 and second light emitting unit 34 to which at least one fourth light emitting unit is connected in parallel, as mentioned above.

Moreover, a location where the PTF unit 36 is connected in parallel with the light emitting unit may be changed, and the number of light emitting units connected in parallel with the PTF unit 36 may also be changed.

As such, it will be apparent that various modifications can be made by adding various elements to the light emitting device according to embodiments of the disclosure via various methods of adding elements through series connection and/or parallel connection, and that such modifications are also within the scope of the present invention.

FIG. 4 is a block diagram of a light emitting device 40 or driving circuits thereof according to an exemplary embodiment of the present invention. In FIG. 4, a resistor 48 is connected between a node $N_{44}$ and the AC voltage source applied between input terminals $IN_1$ and $IN_2$, so that the resistor 48, a parallel connection of a first light emitting unit 42 and a PTF unit 46, and a second light emitting unit 44 are connected in series with one another.

As in FIG. 3, considering mutual connections with the first light emitting unit 42 and the second light emitting unit 44, the PTF unit 46 is connected in parallel with the first light emitting unit 42 and in series with the second light emitting unit 44, thereby allowing the second light emitting unit 44 to be operated before operation of the first light emitting unit 42 when the AC voltage source is applied to the light emitting device. The resistor 48 serves to determine current intensity during operation of the first light emitting unit 42 and/or the second light emitting unit 44.

In FIG. 4, the resistor 48 is illustrated as being connected between the input terminal $IN_2$ of the AC voltage source and the first light emitting unit 42, but may be connected in series between the second light emitting unit 44 and the input terminal $IN_2$ of the AC voltage source.

In FIG. 5, with a resistor 58 connected in series with a first light emitting unit 52, the resistor 58 and the first light emitting unit 52 are connected in parallel with a PTF unit 56. As in FIG. 4, the PTF unit 56 serves to allow the second light emitting unit 54 to be operated before operation of the first light emitting unit 52 when an AC voltage source is applied to the light emitting device 50. Further, the resistor 58 determines current intensity during operation of the first light emitting unit 52 and/or the second light emitting unit 54. Further, as in FIG. 4, the resistor 58 may be connected in series between the second light emitting unit 54 and the input terminal $IN_2$ among input terminals of the AC voltage source.

Figure 2:
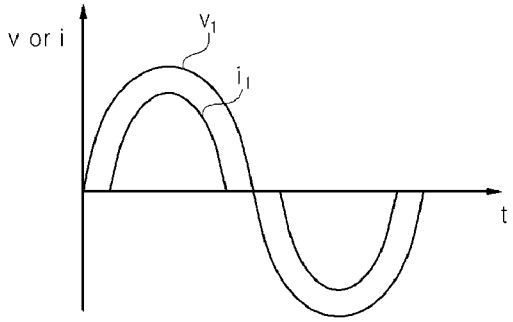
Related Art Fig.2
FIG. 2 is a graph depicting voltage and current characteristics of the AC LED of FIG. 1.
Figure 6:
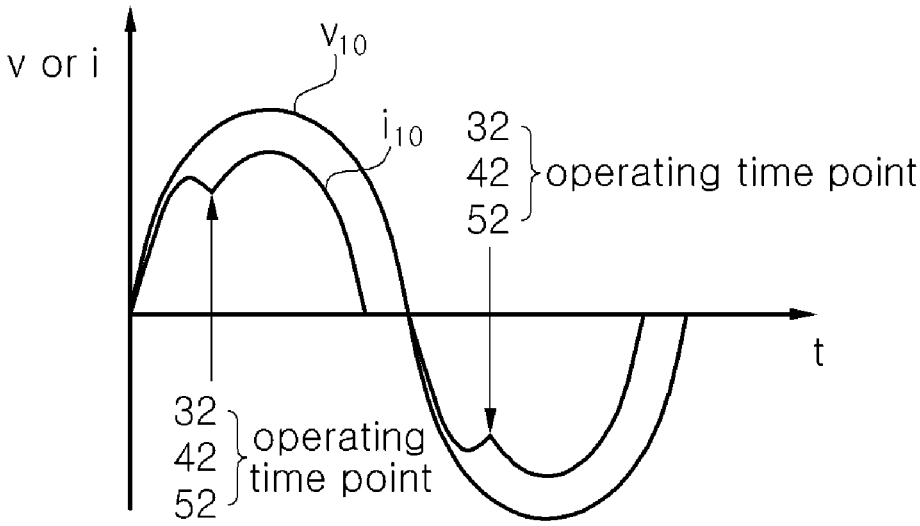
FIG. 6 is a graph depicting voltage and current characteristics of the light emitting devices or the driving circuits thereof shown in FIG. 3, FIG. 4, and FIG. 5.

FIG. 6 is a graph depicting voltage and current characteristics of the light emitting devices 30, 40, 50 or the driving circuits thereof shown in FIG. 3, FIG. 4, and FIG. 5. Referring to FIG. 2 and FIG. 6, it can be understood that the light emitting devices according to the exemplary embodiments of the present invention have wider operating regions than conventional light emitting devices not comprising the PTF units 36, 46, 56. In other words, as shown by a current ($i_{10}$) and voltage ($v_{10}$) graph of FIG. 6, the second light emitting units 34, 44, 54 are operated before operation of the first light emitting units 32, 42, 52, so that the light emitting devices 30, 40, 50 according to exemplary embodiments of the present invention are operated even in a region where the conventional light emitting devices not including the PTF units 36, 46, 56 are not operated. As such, the light emitting devices 30, 40, 50 according to exemplary embodiments of the invention have a much wider operating region and are turned on in advance at a low voltage, thereby enabling a significant reduction in flickering and total harmonic distortion.

In FIG. 3, the first light emitting unit 32 and second light emitting unit 34 may be constituted by the same or different number of AC LEDs. The first light emitting element units 42, 52 and the second light emitting units 44, 54 may also be constituted by the same or different number of AC LEDs. If the number of AC LEDs constituting the first light emitting units 32, 42, 52 is different from those of the second light emitting units 34, 44, 54, this influences operating times of the second light emitting units 34, 44, 54 and operating times of the first light emitting units 32, 42, 52. Therefore, it is desirable that the number of AC LEDs be properly determined according to a desired design of the light emitting device 30, 40, 50. Furthermore, various types of series and/or parallel connections between elements, various types of light emitting units obtained by connecting individual LEDs, and various arrangements of LEDs in a single chip may be adopted in consideration of the AC voltage source or the forward threshold voltages of the LEDs constituting the AC LED as described above.

Figure 7:
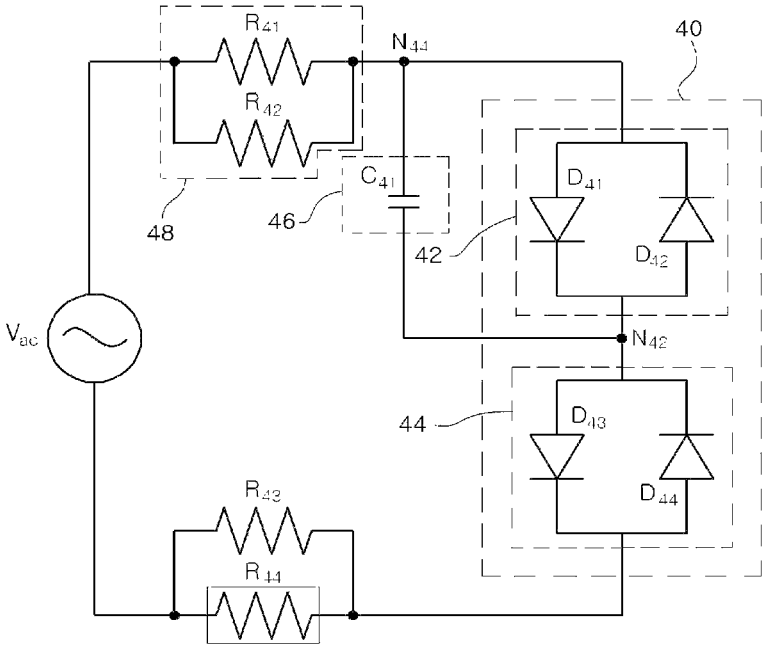
FIG. 7 is an equivalent circuit diagram of the light emitting device or driving circuit thereof shown in FIG. 4.

FIG. 7 is an equivalent circuit diagram of the light emitting device 40 or driving circuit thereof shown in FIG. 4. Referring to FIG. 7, the PTF unit 46 comprises a capacitor $C_{41}$, and each of the first light emitting unit 42 and the second light emitting unit 44 comprises two LEDs. The first light emitting unit 42 is connected in series with the second light emitting unit 44 via a first node $N_{42}$ and is also connected in parallel with the capacitor $C_{41}$. Here, the resistor 48 is connected in series with the first light emitting unit 42 and the capacitor $C_{41}$ via a second node $N_{44}$. In other words, the first light emitting unit 42 is connected in parallel with the capacitor $C_{41}$ between the first node $N_{42}$ and second node $N_{44}$. Further, in regard to connection between the capacitor $C_{41}$ and the first light emitting unit 42 and the second light emitting unit 44, the capacitor $C_{41}$ is connected in parallel with the first light emitting unit 42 and in series with the second light emitting unit 44.

The first light emitting unit 42 comprises first LED $D_{41}$ and second LED $D_{42}$, which are connected in inverse parallel with each other, and the second light emitting unit 44 comprises third LED $D_{43}$ and fourth LED $D_{44}$, which are connected in inverse parallel with each other. It should be noted that the first light emitting unit 42 and the second light emitting unit 44 shown in FIG. 7 show the most basic AC LEDs. Therefore, as described above, each of the first light emitting unit 42 and the second light emitting unit 44 may comprise one or more AC LEDs. Furthermore, a single AC LED (for example, 42) may comprise two or more LEDs so long as they can be operated by application of the AC voltage source.

When an AC voltage source $V_{ac}$ is applied, the first LED $D_{41}$ and the third LED $D_{43}$ are operated in a positive half-period region of the AC voltage source, whereas the second LED $D_{42}$ and the fourth LED $D_{44}$ are operated in a negative half-period region of the AC voltage source. In the positive half-period region of the AC voltage source $V_{ac}$, the third LED $D_{43}$ is operated before operation of the first LED $D_{41}$, and in the negative half-period region of the AC voltage source $V_{ac}$, the fourth LED $D_{44}$ is operated before operation of the second LED $D_{42}$.

Although a single capacitor $C_{41}$ is shown as the PTF unit 46 in FIG. 7, the PTF unit may be a resistor or an inductor, or a connection unit of various elements, such as resistors, capacitors, and the like.

According to one exemplary embodiment, the driving circuit of the light emitting device may further comprise a thermistor $R_{44}$ which is connected in series between the AC voltage source $V_{ac}$ and the light emitting device 40. Generally, the thermistor $R_{44}$ can be classified into a negative temperature coefficient thermistor which has a negative temperature coefficient to allow resistance to decrease as the temperature increases, and a positive temperature coefficient thermistor which has a positive temperature coefficient to allow resistance to increase as the temperature increases. According to this embodiment, the positive temperature coefficient thermistor is used to reduce a current to be supplied to the light emitting device 40 when the temperature of the light emitting device 40 increases.

Further, although the number of resistors 48 and $R_{43}$ for determining current intensity during operation of the light emitting device 40 have been described as two resistors $R_{41}$, $R_{42}$ and a single resistor $R_{43}$ for descriptive convenience, the number and resistances of the resistors and connections therebetween may be variously designed as needed in consideration of the number and rated power of LEDs within the light emitting device 40. Further, although the resistor $R_{43}$ is illustrated as being connected in parallel with the thermistor $R_{44}$, the driving circuit of the light emitting device 40 according to the present invention is not limited to this configuration and can be modified in various configurations.

Figure 8:
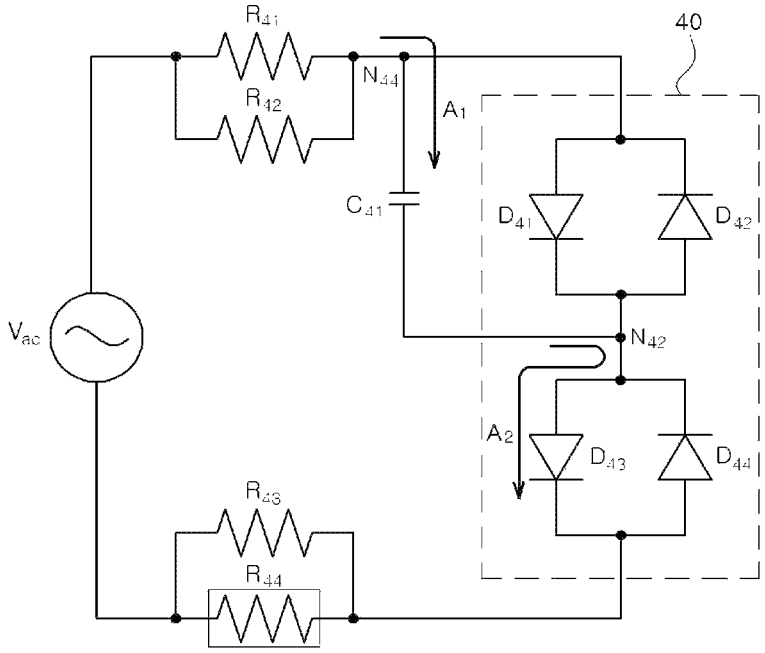
FIG. 8 and FIG. 9 are equivalent circuit diagrams illustrating operation of the light emitting device upon application of a positive half-period of an AC voltage source.
Figure 9:
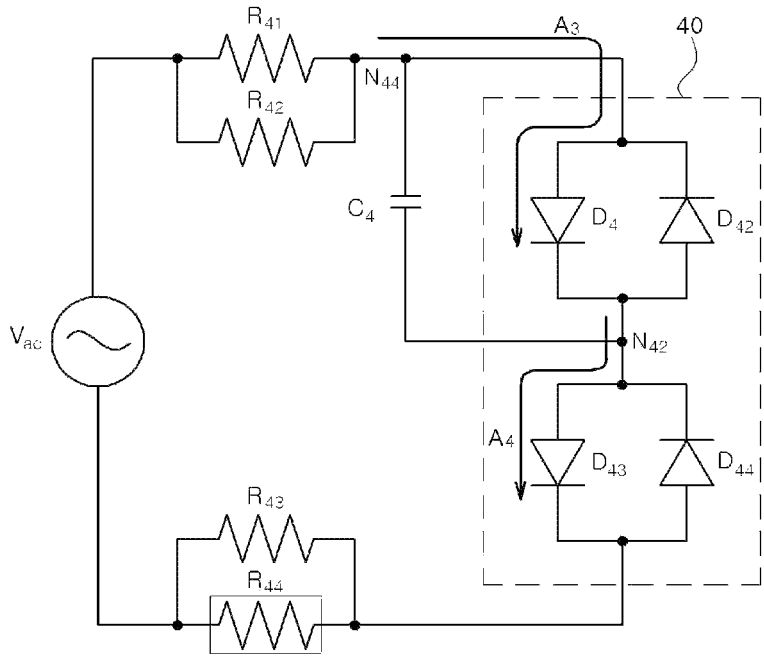
Figure 10:
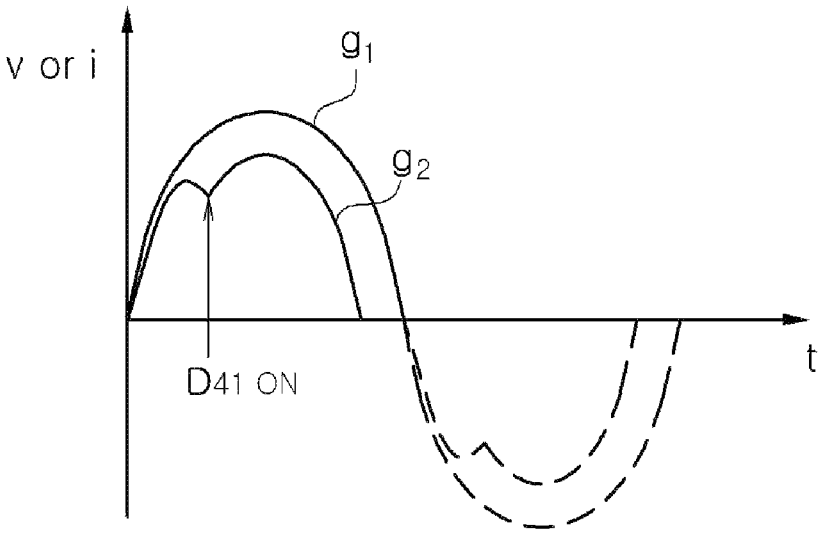
FIG. 10 is a voltage and current graph corresponding to FIG. 8 and FIG. 9.
Figure 11:
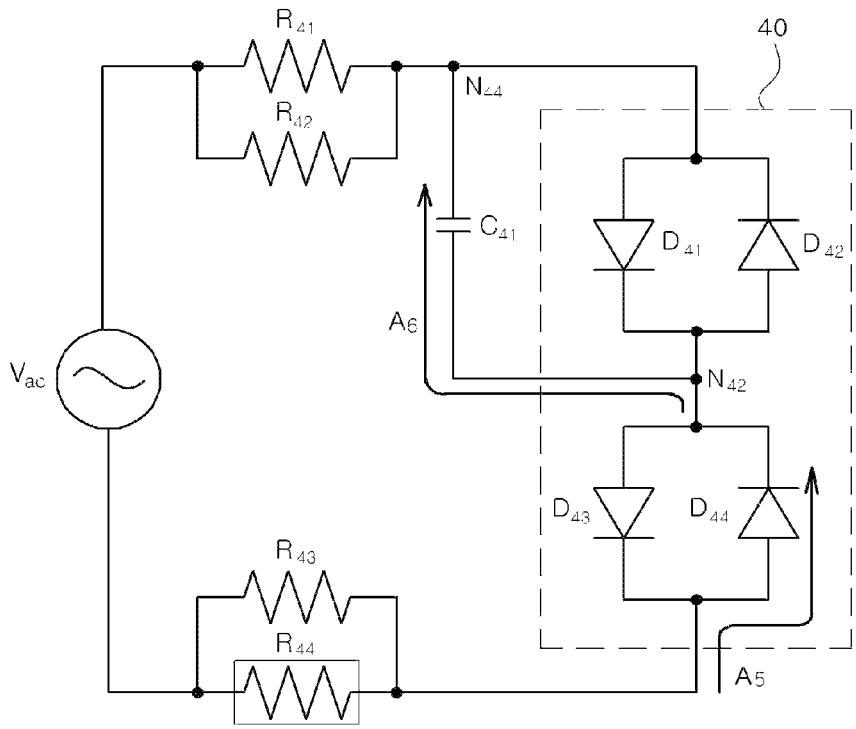
FIG. 11 and FIG. 12 are equivalent circuit diagrams illustrating operation of the light emitting device upon application of a negative half-period of the AC voltage source.
Figure 12:
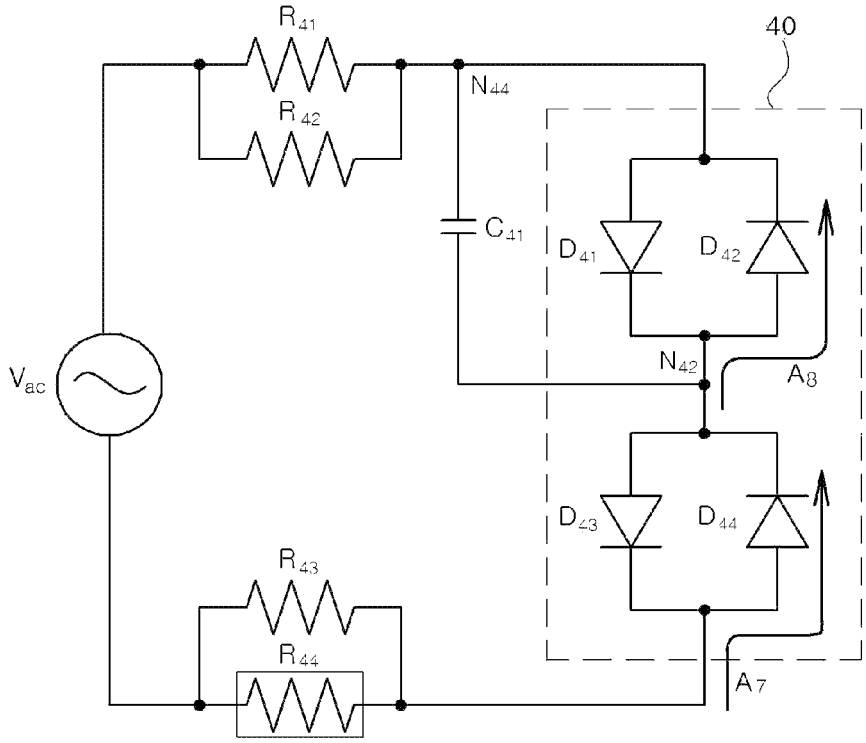
Figure 13:
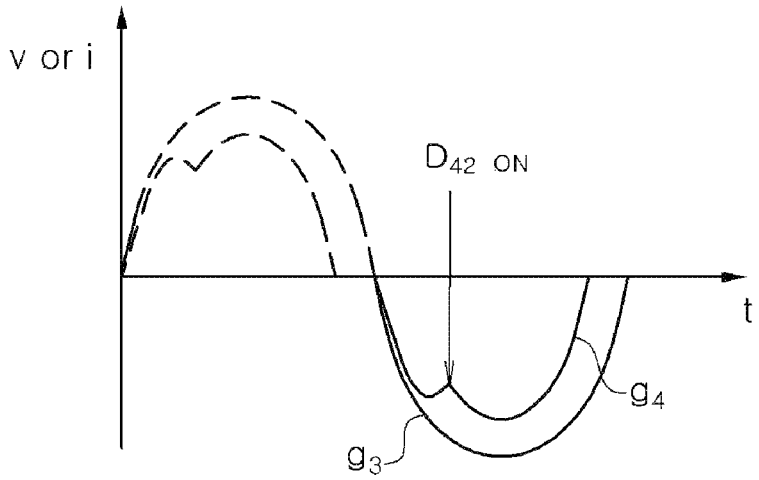
FIG. 13 is a voltage and current graph corresponding to FIG. 11 and FIG. 12.

FIG. 8, FIG. 9, FIG. 10, FIG. 11, FIG. 12, and FIG. 13 are equivalent circuit diagrams and graphs illustrating operation of the light emitting device or driving circuit thereof shown in FIG. 7. Particularly, FIG. 8 and FIG. 9 are equivalent circuit diagrams illustrating operation of the light emitting device upon application of the positive half-period of the AC voltage source $V_{ac}$; FIG. 10 is a voltage and current graph corresponding to FIG. 8 and FIG. 9; FIG. 11 and FIG. 12 are equivalent circuit diagrams illustrating operation of the light emitting device upon application of the negative half-period of the AC voltage source $V_{ac}$; and FIG. 13 is a voltage and current graph corresponding to FIG. 11 and FIG. 12.

Referring to FIG. 8, when the voltage is less than the sum of forward threshold voltages of the first LED $D_{41}$ and the third LED $D_{43}$ in the positive half-period of the AC voltage source $V_{ac}$, only the third LED $D_{43}$ is operated. In other words, electric current flows along a path indicated by arrows $A_1$ and $A_2$. Herein, if the voltage is from 0V to a voltage being less than the forward threshold voltage of the third LED $D_{43}$ in the positive half-period of the AC voltage source $V_{ac}$, the current flows along the path indicated by arrows $A_1$ and $A_2$ due to influence of the capacitor $C_{41}$ even in the case where the voltage is less than the forward threshold voltage of the third LED $D_{43}$ (this can be understood by considering the negative half-period of the AC voltage source $V_{ac}$ described below and the current phase lead phenomenon among operating characteristics of the capacitor $C_{41}$).

Then, as illustrated in FIG. 9, when the voltage increases and becomes higher than the sum of forward threshold voltages of the first LED $D_{41}$ and the third LED $D_{43}$, the current flows along a path indicated by arrows $A_3$ and $A_4$. As a result, the first LED $D_{41}$ and the third LED $D_{43}$ are operated together.

Namely, in the positive half-period of the AC voltage source $V_{ac}$, the current flowing along the path indicated by arrows $A_1$ and $A_2$ is cut-off and then flows along the path indicated by arrows $A_3$ and $A_4$ at a time point where the first LED $D_{41}$ is turned on.

Considering the whole positive half-period of the AC voltage source $V_{ac}$, the third LED $D_{43}$ is turned on to operate before operation of the first LED $D_{41}$ (current path along $A_1$ and $A_2$ of FIG. 8), followed by simultaneous operation of both the first LED $D_{41}$ and the third LED $D_{43}$.

FIG. 10 is a voltage ($g_1$) and current ($g_2$) graph corresponding to FIG. 8 and FIG. 9 in the positive half-period of the AC voltage source $V_{ac}$. Referring to FIG. 10, the third LED $D_{43}$ is operated prior to the first LED $D_{41}$, followed by simultaneous operation of both the first LED $D_{41}$ and the third LED $D_{43}$.

Next, referring to FIG. 11, when the voltage is less than the sum of forward threshold voltages of the second LED $D_{42}$ and the fourth LED $D_{44}$ in the negative half-period of the AC voltage source $V_{ac}$, only the fourth LED $D_{44}$ is operated. In other words, the current flows along a path indicated by arrows $A_5$ and $A_6$. Here, if the voltage is from 0V to a voltage being less than the forward threshold voltage of the fourth LED $D_{44}$ in the negative half-period of the AC voltage source $V_{ac}$, the current flows through the light emitting device along the path indicated by arrows $A_5$ and $A_6$ due to influence of the capacitor $C_{41}$ even in the case where the voltage is less than the forward threshold voltage of the fourth LED $D_{44}$. This can be understood by considering the current phase lead phenomenon among the operating characteristics of the capacitor $C_{41}$, that is, by considering that a current phase precedes a voltage phase.

Then, when the voltage increases and becomes higher than the sum of forward threshold voltages of the second LED $D_{42}$ and the fourth LED $D_{44}$, the current flows along a path indicated by arrows $A_7$ and $A_8$. As a result, the second LED $D_{42}$ and the fourth LED $D_{44}$ are operated together.

Namely, in the negative half-period of the AC voltage source $V_{ac}$, the current flowing through the fourth LED $D_{44}$ towards the capacitor $C_{41}$ is cut-off and then flows through the fourth LED $D_{44}$ and the second LED $D_{42}$ at a time point where the second LED $D_{42}$ is turned on.

Then, a new positive half-period after the negative half-period of the AC voltage source will repeat the operation described above with reference to FIGS. 8 to 10.

FIG. 13 is a voltage ($g_3$) and current ($g_4$) graph corresponding to FIG. 11 and FIG. 13 in the negative half-period of the AC voltage source $V_{ac}$. Referring to FIG. 13, the fourth LED $D_{44}$ is operated prior to the second LED $D_{42}$, followed by simultaneous operation of both the second LED $D_{42}$ and the fourth LED $D_{44}$.

Figure 14:
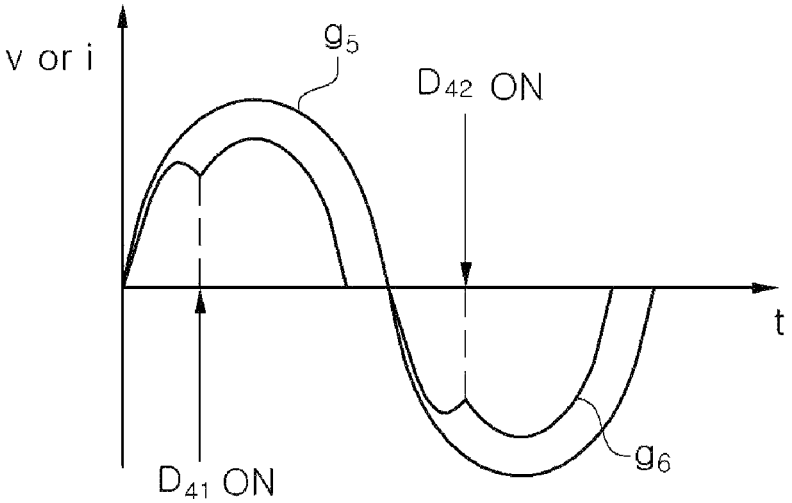
FIG. 14 is a voltage and current graph in a single period of the AC voltage source obtained by combining both the positive and negative half-periods of the AC voltage source illustrated in FIG. 8, FIG. 9, FIG. 10, FIG. 11, FIG. 12, and FIG. 13.

FIG. 14 is a voltage ($g_5$) and current ($g_6$) graph in a single period of the AC voltage source obtained by combining both the positive and negative half-periods of the AC voltage source $V_{ac}$ illustrated in FIG. 8, FIG. 9, FIG. 10, FIG. 11, FIG. 12, and FIG. 13.

Considering the whole single period of the AC voltage source $V_{ac}$, in the positive half-period, the third LED $D_{43}$ is operated prior to the first LED $D_{41}$, followed by simultaneous operation of both first LED $D_{41}$ and the third LED $D_{43}$, and, in the negative half-period, the fourth LED $D_{44}$ is operated prior to the second LED $D_{42}$, followed by simultaneous operation of both second LED $D_{42}$ and the fourth LED $D_{44}$.

When compared with the conventional light emitting device not comprising the PTF unit as shown in FIG. 1 and FIG. 2, the light emitting devices or driving circuits thereof according to the exemplary embodiments of this present invention have wide operating regions. As a result, the light emitting devices according to the exemplary embodiments are unlikely to undergo flickering and abrupt operation, which can occur in the conventional light emitting device upon application of a voltage higher than or equal to the sum of forward threshold voltages of two LEDs connected in a forward direction. Further, the light emitting devices according to the embodiments reduce peak current and total harmonic distortion, and exhibit improved power factor and optical efficiency.

It should be understood that the above exemplary embodiments have been described in view of qualitative analysis in order to effectively illustrate features of the disclosure. That is, there can be a slight difference in operating time points of the first and second light emitting units, considering detailed conditions in actual practice, such as a real capacitance of the capacitor, real resistances of the resistors, and the number and load power of AC LEDs in the light emitting devices or driving circuits thereof according to the embodiments of the disclosure.

Figure 15:
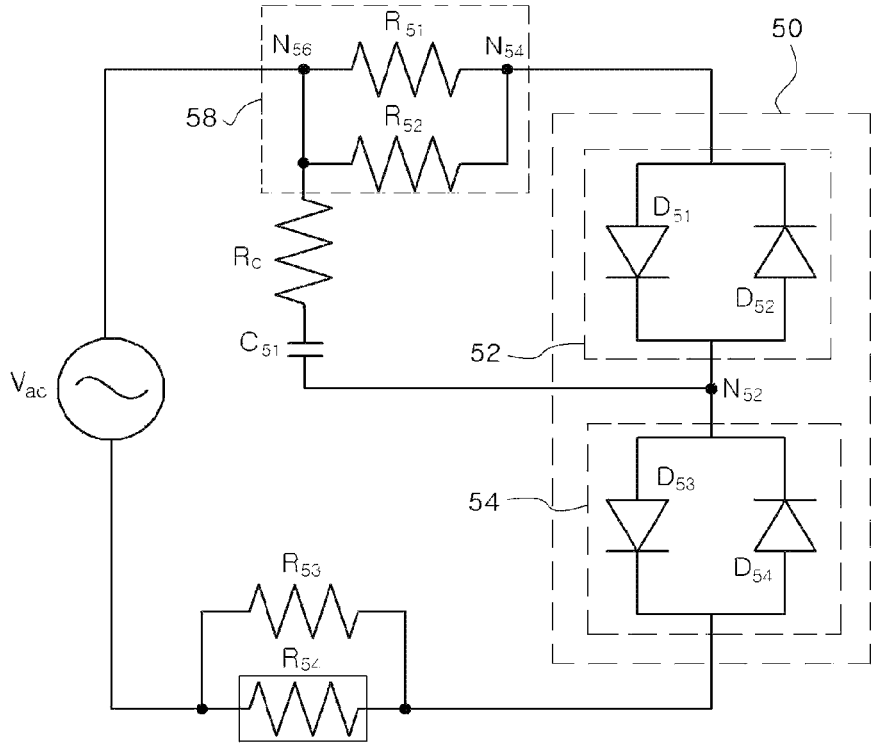
FIG. 15 is an equivalent circuit diagram of the light emitting device or driving circuit thereof shown in FIG. 5, in which the light emitting device comprises a resistor capable of serving as a low-frequency filter.

FIG. 15 is an equivalent circuit diagram of a light emitting device or driving circuit thereof corresponding to the light emitting device shown in FIG. 5, in which the light emitting device comprises a resistor capable of serving as a low-frequency filter. Referring to FIG. 15, a first light emitting unit 52, a second light emitting unit 54, a capacitor $C_{51}$, a first resistor 58, and a second resistor $R_c$ are shown.

The first light emitting unit 52 is connected in series with the second light emitting unit 54 via the first node $N_{52}$ to constitute a light emitting device 50. The driving circuit for driving the light emitting device 50 by application of an AC voltage source $V_{ac}$ thereto comprises the first resistor 58, the capacitor $C_{51}$, and the second resistor $R_c$.

The first resistor 58 is connected in series with the first light emitting unit 52 via the first node $N_{52}$ and determines current intensity during operation of the light emitting device 50. The capacitor $C_{51}$ is connected in parallel with the first light emitting unit 52 and the first resistor 58 between the third node $N_{56}$ and the first node $N_{52}$. The capacitor $C_{51}$ is described above in the description of the PTF unit 56 with reference to FIG. 5.

The second resistor $R_c$ is connected in series with the capacitor $C_{51}$ between the third node $N_{56}$ and the first node $N_{52}$. Viewing from the third node $N_{56}$ towards the first node $N_{52}$, a series connection is illustrated as being made in a sequence from the second resistor $R_c$ to the capacitor $C_{51}$. However, it should be understood that an inverse sequence between the second resistor $R_c$ and the capacitor $C_{51}$ in series connection also has the same function. Further, although the second resistor $R_c$ is illustrated as a single resistor in this embodiment, there is no limit to the number of second resistors or connections therebetween.

The second resistor $R_c$ serves to adjust charge/discharge time of the capacitor $C_{51}$ and can act as a low-frequency filter that blocks radio frequencies caused by electromagnetic interference or noise.

Further, a thermistor $R_{54}$ may be connected in series between the AC voltage source $V_{ac}$ and the light emitting device 50 to perform the functions as described above. The fundamental operation of the light emitting device of this embodiment is substantially the same as that of the light emitting device described above in FIG. 8, FIG. 9, FIG. 10, FIG. 11, FIG. 12, and FIG. 13, and a repetitious description thereof will be omitted herein.

Figure 16:
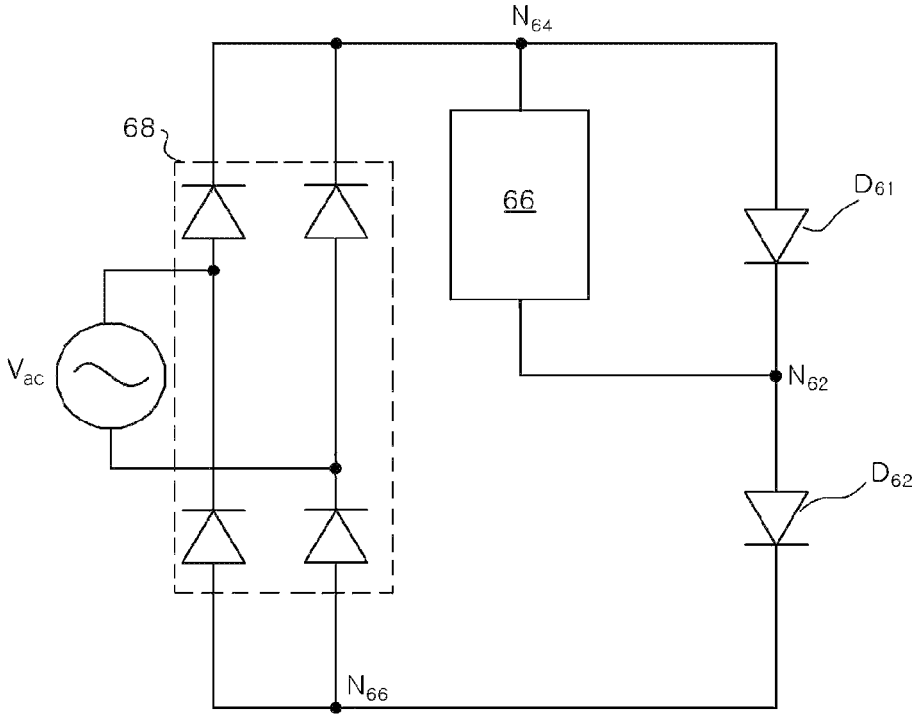
FIG. 16 is an equivalent circuit diagram of a light emitting device or driving circuit thereof according to another exemplary embodiment of the present invention.

FIG. 16 is an equivalent circuit diagram of a light emitting device or driving circuit thereof according to another exemplary embodiment of the present invention. Referring to FIG. 16, the light emitting device or driving circuit thereof comprises a rectifier 68, a first light emitting unit $D_{61}$, a second light emitting unit $D_{62}$, and a PTF unit 66.

Although the rectifier 68 is illustrated as a bridge rectifying circuit with four rectifying diodes in this embodiment, various types of rectifying circuits can be used.

Further, although each of the first light emitting unit $D_{61}$ and the second light emitting unit $D_{62}$ is illustrated as comprising one LED, the disclosure is not limited to this configuration. For example, each of the first light emitting unit $D_{61}$ and the second light emitting unit $D_{62}$ may comprise multiple LEDs connected in series and/or parallel with each other in a forward direction.

Figure 17:
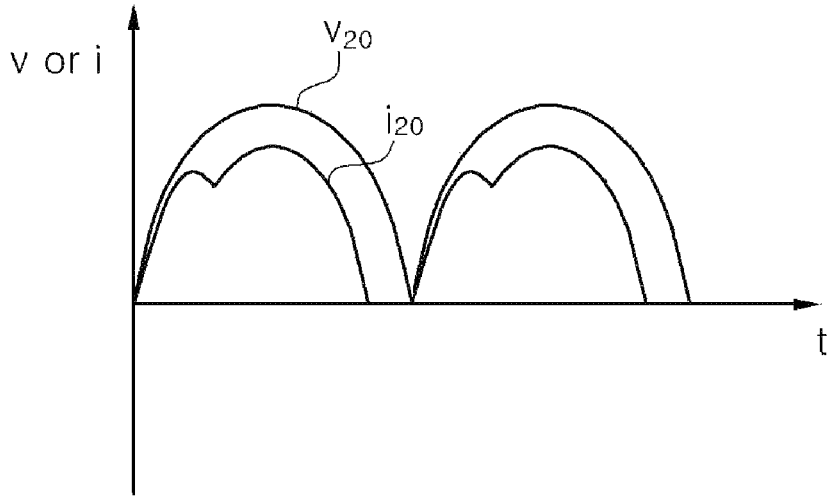
FIG. 17 is a voltage and current graph corresponding to FIG. 16.

FIG. 17 is a voltage ($v_{20}$) and current ($i_{20}$) graph corresponding to FIG. 16. As can be seen from a current graph ($i_{20}$) of FIG. 17, the light emitting device is operated much faster than a light emitting device that does not comprise the PTF unit 66 (see the current graph ($i_1$) in the positive half-period of FIG. 2).

Figure 18:
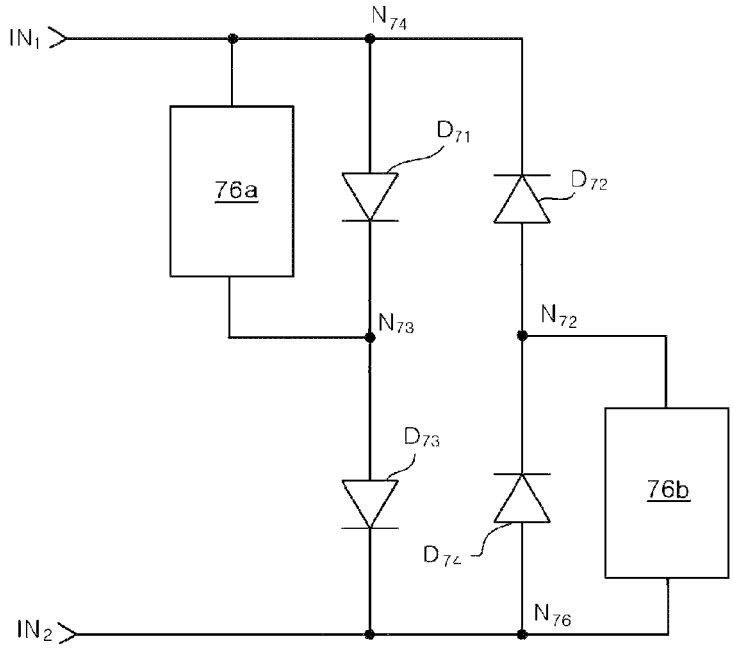
FIG. 18 is an equivalent circuit diagram of a light emitting device or driving circuit thereof according to a further exemplary embodiment of the present invention.

FIG. 18 is an equivalent circuit diagram of a light emitting device or driving circuit thereof according to a further exemplary embodiment of the present invention. Referring to FIG. 18, first light emitting units $D_{71}$, $D_{73}$, second light emitting units $D_{72}$, $D_{74}$, a first PTF unit 76*a*, and a second PTF unit 76*b* are shown.

Each of the first light emitting units $D_{71}$, $D_{73}$ and the second light emitting units $D_{72}$, $D_{74}$ comprises at least two LEDs connected in series in the forward direction. Although each of the light emitting units is shown as comprising the two LEDs connected in series in the forward direction in FIG. 18, each of the light emitting units may comprise multiple LEDs connected in series in the forward direction as in the above embodiments.

The first PTF unit 76*a* is connected in parallel with one of the LEDs in the first light emitting units $D_{71}$, $D_{73}$, and the second PTF unit 76*b* is connected in parallel with one of the LEDs in the second light emitting units $D_{72}$, $D_{74}$. As described above, each of the first PTF unit 76*a* and the second PTF unit 76*b* may comprise a variety of elements, such as resistors, capacitors, inductors, and the like. The first PTF unit 76*a* allows the LED $D_{73}$ of the first light emitting unit to be operated before operation of the LED $D_{71}$ thereof, and the second PTF unit 76*b* allows the LED $D_{72}$ of the second light emitting unit to be operated before operation of the LED $D_{74}$ thereof.

In FIGS. 3 to 18, the light emitting devices and the driving circuits thereof have not been clearly divided in the description thereof, and in some cases, the light emitting devices have been illustrated as comprising only the light emitting units. For example, in FIG. 3, a thing comprising all the first light emitting unit 32, second light emitting unit 34, and PTF unit 36 can be construed as the light emitting device, or a series connection 40 of the light emitting units can be construed as the light emitting device. For the latter case, since the remaining part comprising the PTF unit 36 (and, for example, the resistors 48, R43, R44, and the like in FIG. 7) can be construed as the driving circuit of the light emitting device, the light emitting device and the driving circuit thereof are not clearly divided in the description thereof.

Figure 19:
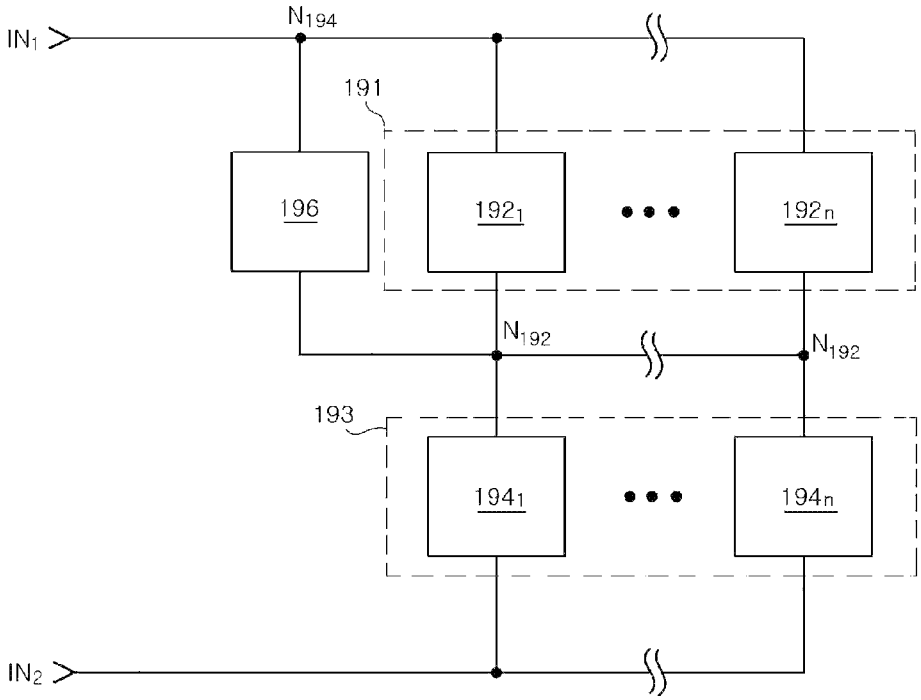
FIG. 19 and FIG. 20 are block diagrams of light emitting devices or driving circuits thereof according to still other exemplary embodiments of the present invention.
Figure 20:
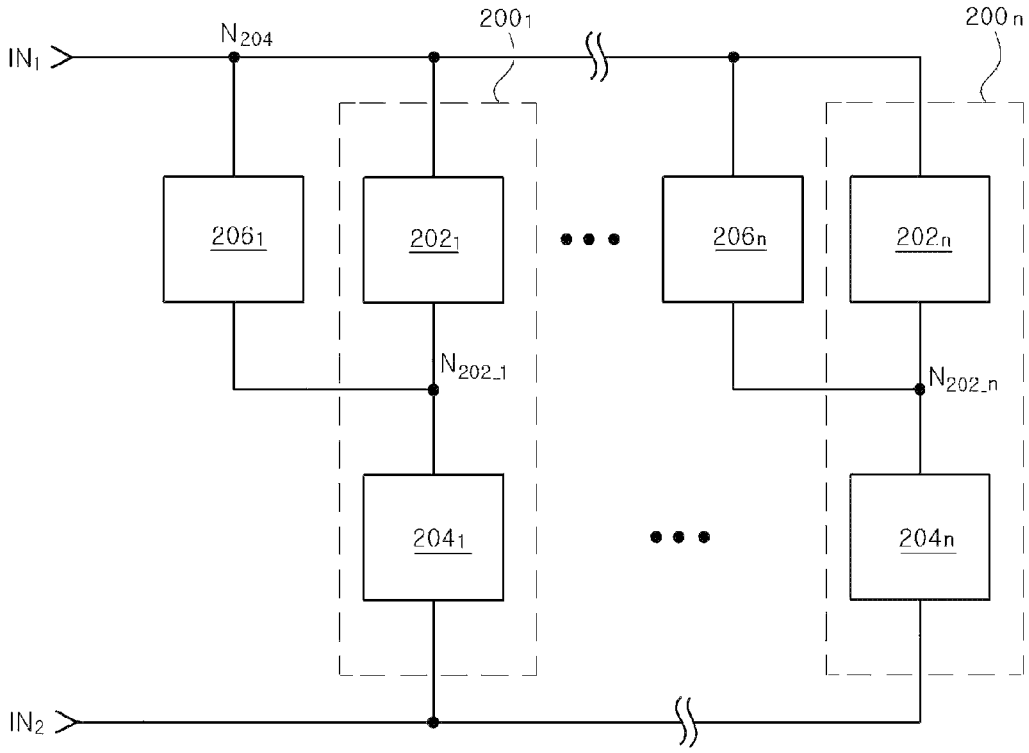

FIG. 19 and FIG. 20 are block diagrams of light emitting devices or driving circuits thereof according to still other exemplary embodiments of the present invention. First, referring to FIG. 19, the light emitting device comprises: a first light emitting group 191, which comprises one or more first light emitting units $\mathbf{192}_1, \ldots, \mathbf{192}_n$, each of which comprises at least one LED; a second light emitting group 193, which comprises one or more second light emitting units $\mathbf{194}_1, \ldots, \mathbf{194}_n$, each of which comprises at least one LED; and a PTF unit 196 connected in parallel with the first light emitting group 191 and in series with the second light emitting group 193. The PTF unit 196 allows the second light emitting group 193 to be operated prior to the first light emitting group 191 when an AC voltage source is applied via input terminals $IN_1$, $IN_2$.

When the first light emitting group 191 comprises a single first light emitting unit (for example, $\mathbf{192}_1$), the first light emitting group 191 becomes the first light emitting unit $\mathbf{192}_1$, and this configuration is the same as the embodiment described in FIG. 3. This is also applied to the second light emitting group 193. Therefore, in this embodiment, the first light emitting group 191 will be described as comprising two or more first light emitting units $\mathbf{192}_1, \ldots, \mathbf{192}_n$, and the second light emitting group 193 will also be described as comprising two or more second light emitting units $\mathbf{194}_1, \ldots, \mathbf{194}_n$.

The first light emitting units $\mathbf{192}_1, \ldots, \mathbf{192}_n$ are connected in parallel with each other between a node $N_{194}$ and a node $N_{192}$. The PHT unit 196 is connected between the node $N_{194}$ and the node $N_{192}$ to be commonly connected in parallel with the first light emitting units $\mathbf{192}_1, \ldots, \mathbf{192}_n$.

Similarly, the second light emitting units $\mathbf{194}_1, \ldots, \mathbf{194}_n$ are also connected in parallel with each other.

As a result, the PTF unit 196 is connected in parallel with the first light emitting group 191 and in series with the second light emitting group 193, as described above.

Figure 21:
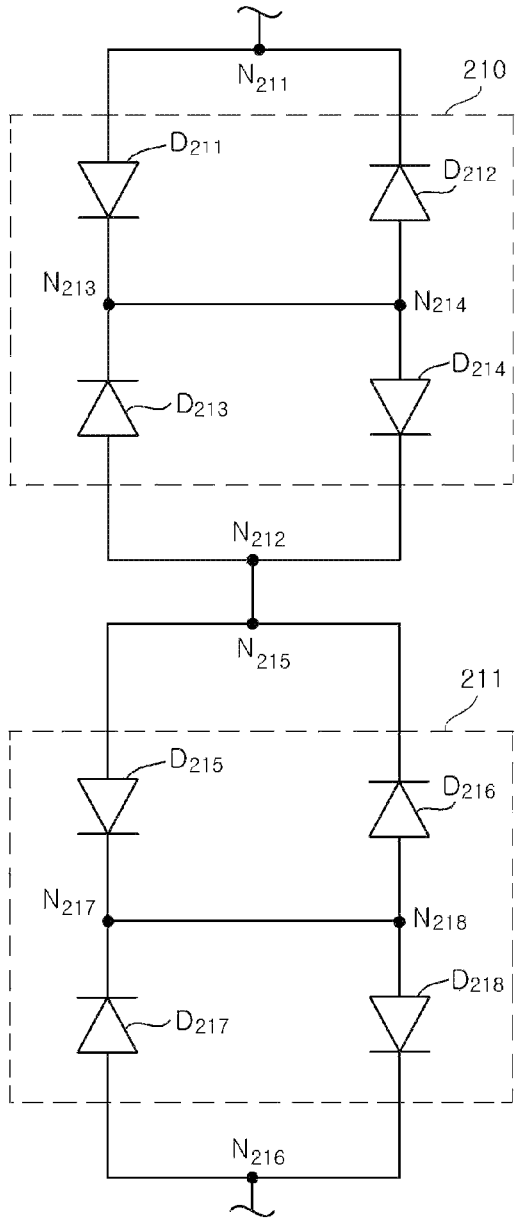
FIG. 21 and FIG. 22 are equivalent circuit diagrams of examples of a light emitting unit according to one exemplary embodiment of the present invention.
Figure 22:
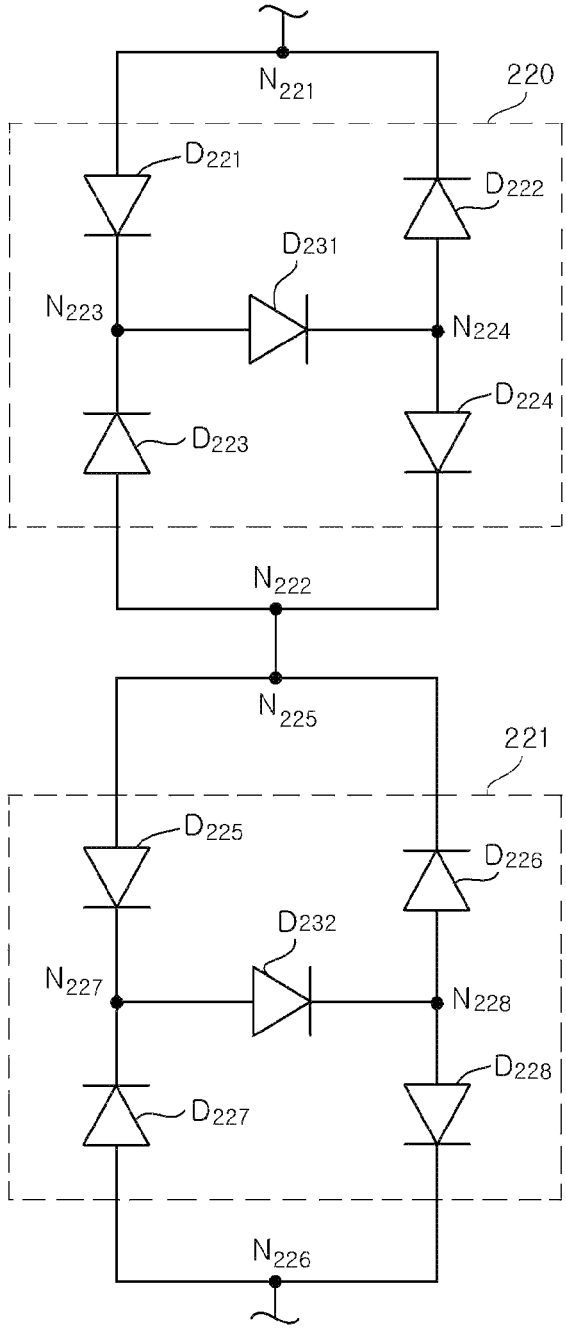
Figure 23:
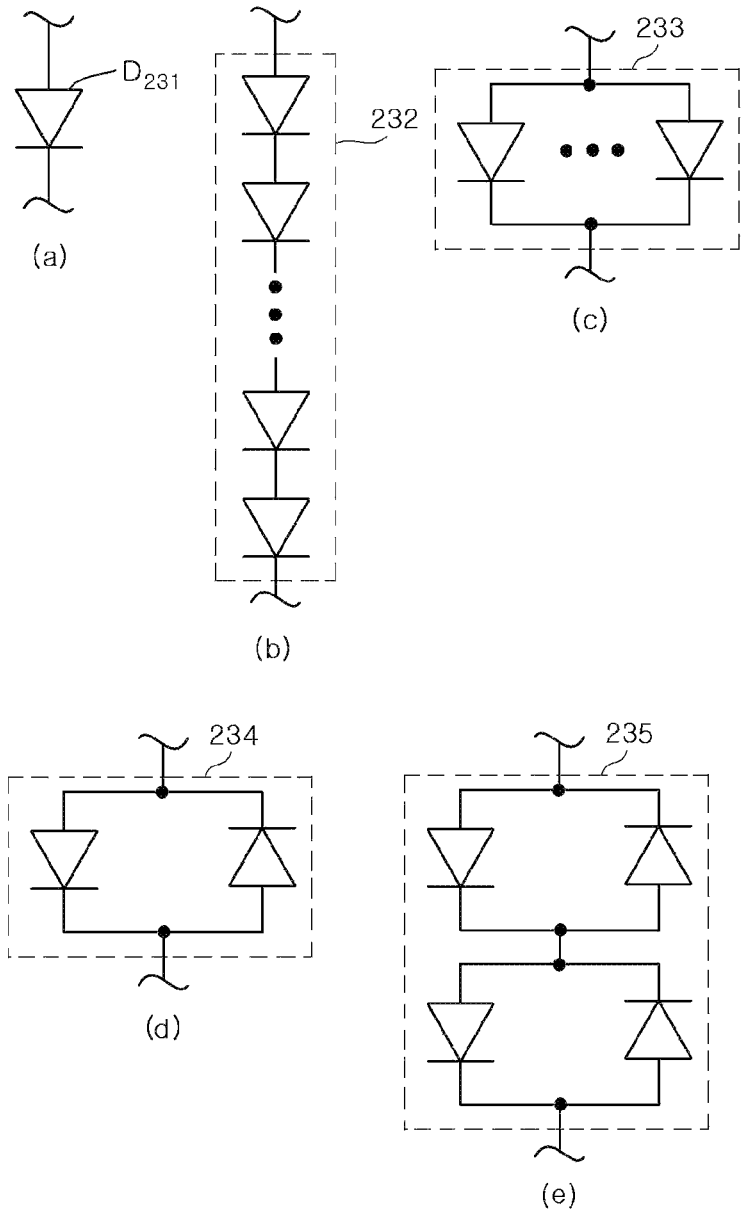
FIG. 23 is equivalent circuit diagrams of various examples of a light emitting unit according to one exemplary embodiment of the present invention.

Referring to FIG. 21, FIG. 22, and FIG. 23, each of the first light emitting units $\mathbf{192}_1, \ldots, \mathbf{192}_n$ and each of the second light emitting units $\mathbf{194}_1, \ldots, \mathbf{194}_n$ may be constituted by a single LED (FIG. 23(*a*)) or by any one selected from a series connection (FIG. 23(*b*)), a parallel connection (FIG. 23(*c*)), an inverse parallel connection (FIG. 23(*d*)), a combination (FIG. 23(*e*)) of inverse parallel connections, and a combination of serial or parallel connections between multiple LEDs. However, the present disclosure is not limited thereto.

The first light emitting group 191 and the second light emitting group 193 may be realized in various manners. For example, the first light emitting group 191 or the second light emitting group 193 may be formed in a single package on a single substrate by a monolithic integrated-circuit process. Alternatively, each of the first light emitting units $\mathbf{192}_1, \ldots, \mathbf{192}_n$ or each of the second light emitting units $\mathbf{194}_1, \ldots, \mathbf{194}_n$ may be formed in a separate package. Alternatively, each of the LEDs (for example, LEDs shown in FIG. 21, FIG. 22, and FIG. 23) in the first light emitting units $\mathbf{192}_1, \ldots, \mathbf{192}_n$ or each of the LEDs (for example, LEDs shown in FIG. 21, FIG. 22, and FIG. 23) in the second light emitting units $\mathbf{194}_1, \ldots, \mathbf{194}_n$ may be formed in a separate package. Furthermore, with the first light emitting group 191 or the second light emitting group 193 formed in a single package, each of the LEDs (for example, LEDs shown in FIG. 21, FIG. 22, and FIG. 23) in the first light emitting group 191 or each of the LEDs (for example, LEDs shown in FIG. 21, FIG. 22, and FIG. 23) in the second light emitting group 193 may be formed in a separate package.

Referring to FIG. 20, the first light emitting group comprises one or more light emitting units $\mathbf{202}_1, \ldots, \mathbf{202}_n$, and the second light emitting group comprises one or more light emitting units $\mathbf{204}_1, \ldots, \mathbf{204}_n$. In this case, when the first light emitting group comprises only a single first light emitting unit (for example, $\mathbf{202}_1$), the first light emitting group becomes the first light emitting unit, and this configuration is the same as the embodiment described in FIG. 3. This is also applied to the second light emitting group. Therefore, in this embodiment, the first light emitting group will be described as comprising two or more first light emitting units $\mathbf{202}_1, \ldots, \mathbf{202}_n$, and the second light emitting group will also be described as comprising two or more second light emitting units $\mathbf{204}_1, \ldots, \mathbf{204}_n$.

Each of the first light emitting units $\mathbf{202}_1, \ldots, \mathbf{202}_n$ is correspondingly connected in series with each of the second light emitting units $\mathbf{204}_1, \ldots, \mathbf{204}_n$. In other words, one of the first light emitting units (for example, $\mathbf{202}_1$) in the first light emitting group corresponds to one of the second light emitting units (for example, $\mathbf{204}_1$) in the second light emitting group to constitute one series connection $\mathbf{200}_1$. Each of PTF units $\mathbf{206}_1, \ldots, \mathbf{206}_n$ is connected in parallel with each of the first light emitting units $\mathbf{202}_1, \ldots, \mathbf{202}_n$.

In this exemplary embodiment, the LEDs constituting each of the light emitting units $\mathbf{202}_1, \ldots, \mathbf{202}_n$; $\mathbf{204}_1, \ldots, \mathbf{204}_n$ may be connected in various manners as shown in FIG. 21, FIG. 22, and FIG. 23.

Further, each of the light emitting units $\mathbf{202}_1, \ldots, \mathbf{202}_n$; $\mathbf{204}_1, \ldots, \mathbf{204}_n$ may be formed in a separate package or may be formed together with each of the associated PTF units $\mathbf{206}_1, \ldots, \mathbf{206}_n$ in a separate package. Alternatively, each of the LEDs constituting the light emitting units $202_1, \ldots, 202_n$; $204_1, \ldots, 204_n$ may be formed in a separate package.

FIG. 21 and FIG. 22 are equivalent circuit diagrams of examples of a light emitting unit according to one embodiment of the present invention. Referring to FIG. 21, a first light emitting unit 210 is connected in series with a second light emitting unit 211 via a node $N_{212}$.

The first light emitting unit 210 comprises a first LED $D_{211}$, a second LED $D_{212}$, a third LED $D_{213}$, and a fourth LED $D_{214}$ that are connected to one another via a first node $N_{211}$, a second node $N_{212}$, a third node $N_{213}$, and a fourth node $N_{214}$.

The first node $N_{211}$ and the second node $N_{212}$ are nodes through which PTF units (not shown) are connected in parallel with the first light emitting unit 210. Further, the second node $N_{212}$ is a node to which the second light emitting unit 211 is connected.

In connections between the first LED $D_{211}$, the second LED $D_{212}$, the third LED $D_{213}$, and the fourth LED $D_{214}$ through the first node $N_{211}$, the second node $N_{212}$, the third node $N_{213}$, and the fourth node $N_{214}$; the first LED $D_{211}$ is connected in a forward direction from the first node $N_{211}$ towards the third node $N_{213}$, the second LED $D_{212}$ is connected in a forward direction from the fourth node $N_{214}$ towards the first node $N_{211}$, the third LED $D_{213}$ is connected in a forward direction from the second node $N_{212}$ towards the third node $N_{213}$, and the fourth LED $D_{214}$ is connected in a forward direction from the fourth node $N_{214}$ towards the second node $N_{212}$. Here, the third node $N_{213}$ is electrically connected to the fourth node $N_{214}$ by, for example, an electrical wire or the like. Similarly, the LEDs of the second light emitting unit 211 have the same connections as those of the LEDs of the first light emitting unit 210.

FIG. 22 shows one example of a light emitting unit which further comprises a fifth LED $D_{231}$ between the nodes $N_{213}$ and $N_{214}$ of FIG. 21. In other words, the fifth LED $D_{231}$ is connected in a forward direction from a third node $N_{223}$ towards a fourth node $N_{224}$, in between the third node $N_{223}$ and the fourth node $N_{224}$.

According to the embodiments as shown in FIG. 21 and FIG. 22, the light emitting devices can further reduce total harmonic distortion and flickering, and can improve optical efficiency through connections between the LEDs within the light emitting unit.

FIG. 23 is an equivalent circuit diagrams of various examples of a light emitting unit according to one exemplary embodiment of the present invention. In FIG. 23, (a) illustrates a light emitting unit comprising a single LED, (b) illustrates a light emitting unit comprising multiple LEDs connected in series with each other, (c) illustrates a light emitting unit comprising multiple LEDs connected in parallel with each other, (d) illustrates a light emitting unit comprising multiple LEDs connected in inverse parallel with each other, and (e) illustrates a light emitting unit comprising a combination of inverse parallel connections between multiple LEDs.

For example, when an AC voltage source is directly applied to a light emitting device comprising such various light emitting units without a rectifier circuit, it is desirable that the LEDs of the light emitting unit be connected in inverse parallel with each other as shown in (d) or (e). On the contrary, when the AC voltage source is applied to the light emitting device through the rectifier circuit, it is desirable that the LEDs be connected in a single direction as shown in (a), (b) or (c).

As apparent from the above description, according to embodiments of the disclosure, the light emitting device and the driving circuit thereof can solve problems, such as a decrease in power factor, severe total harmonic distortion, excessive flickering, and the like, due to operating characteristics of an AC LED, that is, a sudden current when an AC voltage source applied to the AC LED is higher than or equal to the sum of forward threshold voltages of LEDs connected in a forward direction with respect to the voltage and a short operating region of the AC LED for a single period of the AC voltage source.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A light emitting device, comprising:

a first light emitting unit and a second light emitting unit connected in series with each other, each of the first light emitting unit and the second light emitting unit comprising at least one light emitting diode (LED); and a PTF unit connected in parallel with the first light emitting unit and in series with the second light emitting unit, the PTF unit to allow the second light emitting unit to be operated before operation of the first light emitting unit upon application of an AC voltage source, wherein one or both of the first light emitting unit and the second light emitting unit comprise two LEDs connected in inverse parallel with each other.

2. The light emitting device of claim 1, wherein the first light emitting unit comprises first and second LEDs connected in inverse parallel with each other, and the second light emitting unit comprises third and fourth LEDs connected in inverse parallel with each other, wherein the first and third LEDs are operated in a positive half-period region of the AC voltage source, in which the third LED is operated before operation of the first LED, and the second and fourth LEDs are operated in a negative half-period region of the AC voltage source, in which the fourth LED is operated before operation of the second LED.

3. The light emitting device of claim 1, wherein the PTF unit comprises a capacitor.

4. A light emitting device, comprising:

a first light emitting group comprising at least one first light emitting unit comprising at least one light emitting diode (LED);

a second light emitting group comprising at least one second light emitting unit comprising at least one LED; and at least one PTF unit connected in parallel with the first light emitting group and in series with the second light emitting group, wherein the first light emitting unit comprises a first LED, a second LED, a third LED, and a fourth LED connected to each other by first node, a second node, a third node, and a fourth node, the first LED being connected in a forward direction from the first node toward the third node, the second LED being connected in a forward direction from the fourth node toward the first node, the third LED being connected in a forward direction from the second node toward the third node, the fourth LED being connected in a forward direction from the fourth node toward the second node, and the third node being electrically connected to the fourth node.

5. The light emitting device of claim 4, wherein when the first light emitting group comprises at least two first light emitting units, the first light emitting units are connected in parallel with each other, and the PTF unit is commonly connected in parallel with the first light emitting units.

6. The light emitting device of claim 5, wherein when one or both of the first light emitting unit and the second light emitting unit comprise at least two LEDs, the at least two LEDs are connected to each other according to any one connection relationship comprising a forward series connection, a parallel connection, an inverse parallel connection, and a combination of series or parallel connections.

7. The light emitting device of claim 5, wherein the first light emitting group or the second light emitting group is monolithically integrated on a single substrate.

8. The light emitting device of claim 5, wherein each of the first light emitting units or each of the second light emitting units is formed in a separate package.

9. The light emitting device of claim 5, wherein each of the LEDs within the first light emitting units or each of the LEDs within the second light emitting units is formed in a separate package.

10. The light emitting device of claim 5, wherein the first light emitting group or the second light emitting group is formed in a single package and each of the LEDs within the first light emitting group or second light emitting group is formed in a separate package.

11. The light emitting device of claim 4, wherein the first light emitting group comprises at least two first light emitting units, the second light emitting group comprises at least two second light emitting units, each of the first light emitting units being connected in series with each of the corresponding second light emitting units, wherein the PTF unit is connected in parallel with the first light emitting units.

12. The light emitting device of claim 4, wherein the PTF unit comprises a capacitor.

13. The light emitting device of claim 4, further comprising:

a fifth LED connected in a forward direction from the third node toward the fourth node between the third node and fourth node.

14. A light emitting device, comprising:

a first light emitting unit comprising at least one light emitting diode (LED);

a second light emitting unit connected in series with the first light emitting unit and comprising at least one LED; and a PTF unit connected in parallel with the first light emitting unit and in series with the second light emitting unit, wherein the PTF unit supplies a driving signal to the second light emitting unit, such that the first light emitting unit does not emit light and only the second light emitting unit selectively emits light, when an AC voltage input to the PTF is less than the sum of a forward threshold voltage of the at least one LED in the first light emitting unit and a forward threshold voltage of the at least one LED in the second light emitting unit.

15. The light emitting device of claim 14, wherein the PTF unit comprises one of a resistor, a capacitor, and an inductor.

16. A light emitting device, comprising:

a first light emitting group comprising at least one first light emitting unit comprising at least one light emitting diode (LED);

a second light emitting group connected in series with the first light emitting group and comprising at least one second light emitting unit comprising at least one LED; and at least one PTF unit connected in parallel with the first light emitting group and in series with the second light emitting group, wherein the PTF unit supplies a driving signal to the second light emitting group, such that the first light emitting group does not emit light and only the second light emitting group selectively emits light, when an AC voltage input to the PTF is less than the sum of a forward threshold voltage of the at least one LED in the first light emitting group and a forward threshold voltage of the at least one LED in the second light emitting group.

17. The light emitting device of claim 16, wherein the PTF unit comprises one of a resistor, a capacitor, and an inductor.

* * * * *